US012146321B2

(12) United States Patent
Kolloch

(10) Patent No.: US 12,146,321 B2
(45) Date of Patent: Nov. 19, 2024

(54) ANCHORAGE DEVICE, ANCHORAGE COMPRISING THE ANCHORAGE DEVICE AND METHOD OF PRODUCING THE ANCHORAGE

(71) Applicant: GTK GEWINDETECHNIK KLEYMANN GMBH & CO. KG, Werlte (DE)

(72) Inventor: Thomas Kolloch, Meppen (DE)

(73) Assignee: GTK Gewindetechnik Kleymann GmbH & Co. KG, Werlte (DE)

( * ) Notice: Subject to any disclaimer, the term of this patent is extended or adjusted under 35 U.S.C. 154(b) by 0 days.

(21) Appl. No.: 17/772,681

(22) PCT Filed: Sep. 30, 2020

(86) PCT No.: PCT/EP2020/077355
§ 371 (c)(1),
(2) Date: Apr. 28, 2022

(87) PCT Pub. No.: WO2021/083598
PCT Pub. Date: May 6, 2021

(65) Prior Publication Data

US 2023/0358044 A1 Nov. 9, 2023

(30) Foreign Application Priority Data

Oct. 31, 2019 (DE) ..... 10 2019 007 619.2
Oct. 31, 2019 (EP) ..... 19000495

(51) Int. Cl.
*E04C 3/32* (2006.01)
*E02D 27/42* (2006.01)
(Continued)

(52) U.S. Cl.
CPC ..... *E04C 3/32* (2013.01); *E02D 27/42* (2013.01); *E04B 1/4157* (2013.01); *E04H 12/2261* (2013.01); *E04B 2001/2463* (2013.01)

(58) Field of Classification Search
CPC ..... E04C 3/32; E02D 27/42; E04B 1/4157; E04B 2001/2463; E04H 12/2261
See application file for complete search history.

(56) References Cited

U.S. PATENT DOCUMENTS 3,918,229 A * 11/1975 Schweinberger ..... E02D 27/14 52/295
5,505,033 A * 4/1996 Matsuo ..... E02D 27/42 52/169.9
(Continued)

FOREIGN PATENT DOCUMENTS

CN 107339003 A * 11/2017 ..... E02D 27/42
CN 110067257 A * 7/2019 ..... E02D 27/42
(Continued)

OTHER PUBLICATIONS

PCT International Search Report and Written Opinion, PCT/EP2020/077355, Nov. 9, 2020, 15 pages.
(Continued)

*Primary Examiner* — Jessie T Fonseca
(74) *Attorney, Agent, or Firm* — Quarles & Brady LLP

(57) ABSTRACT

An anchoring device, an anchorage comprising an anchoring device, and a method for producing the anchoring device.

16 Claims, 9 Drawing Sheets

(51) Int. Cl.

| | |
|---|---|
| ***E04B 1/41*** | (2006.01) |
| ***E04H 12/22*** | (2006.01) |
| *E04B 1/24* | (2006.01) |

(56) References Cited

U.S. PATENT DOCUMENTS

| | | | | |
|---|---|---|---|---|
| 5,533,835 | A | 7/1996 | Angelette | |
| 6,722,821 | B1 * | 4/2004 | Perko | E02D 5/801 405/249 |
| 9,212,486 | B2 * | 12/2015 | Tanaka | E04C 3/32 |
| 2004/0093818 | A1 * | 5/2004 | Simmons | E02D 27/42 52/297 |
| 2006/0048471 | A1 * | 3/2006 | Lee | E02D 27/00 52/296 |
| 2008/0104924 | A1 * | 5/2008 | Wilhour | E02D 27/42 52/741.11 |
| 2010/0107545 | A1 * | 5/2010 | Montague | E04B 1/24 52/745.19 |
| 2015/0259914 | A1 * | 9/2015 | Tanaka | E04H 9/021 52/854 |
| 2015/0259917 | A1 | 9/2015 | Tanaka et al. | |

FOREIGN PATENT DOCUMENTS

| | | | | |
|---|---|---|---|---|
| CN | 111075113 | A * | 4/2020 | E02D 27/42 |
| DE | 19728866 | A1 | 2/1999 | |
| DE | 102006017748 | A1 | 10/2007 | |
| DE | 102019007619 | A1 * | 5/2021 | E02D 27/42 |
| JP | 3052032 | U | 9/1998 | |
| JP | H11140883 | A | 5/1999 | |
| JP | H11158884 | A | 6/1999 | |
| WO | 2010047608 | A1 | 4/2010 | |

OTHER PUBLICATIONS

Japanese Patent Office, Notice of Reasons for Rejection, Application No. 2022-525448, Jul. 23, 2024, 6 pages.

* cited by examiner

ANCHORAGE DEVICE, ANCHORAGE COMPRISING THE ANCHORAGE DEVICE AND METHOD OF PRODUCING THE ANCHORAGE

This application represents the national stage entry of PCT International Patent Application No. PCT/EP2020/077355 filed on Sep. 30, 2020 and claims priority to German Patent Application No. 10 2019 007 619.2 filed Oct. 31, 2019 and European Patent Application 19000495.2 filed Oct. 31, 2019. The contents of each of these applications are hereby incorporated by reference as if set forth in their entirety herein.

The disclosure_relates to an anchoring device. Furthermore, the disclosure relates to an anchorage comprising an anchoring device. Also, the disclosure relates to a method for producing the anchorage.

A plurality of anchoring devices are known from the state of the art. In the construction trade, an anchor is a component for the tension-proof connection (anchorage) of components. Anchors predominantly consist of steel, but they can also be produced from wood, ferroconcrete or prestressed concrete or other tension-proof materials. The anchoring devices made of steel can consist of stirrups and main bars and can be welded together to form a cage. Depending on the use, different materials and amounts can be used.

The state of the art is disadvantageous in that the known anchoring devices have to be welded, which is why the anchoring devices cannot be adjusted afterward.

Hence, the object of the present disclosure is to overcome the disadvantages known from the state of the art.

This object is attained by an anchoring device having the features of claim 1, by an anchorage comprising an anchoring device having the features of claim 8, and by a method for producing the anchorage having the features of claim 13.

The anchoring device according to the disclosure comprises at least two, preferably three and particularly preferably four anchor rods and a first anchor plate, the first anchor plate having a preferably central recess, in particular for accommodating a pocket formwork, and openings, each anchor rod being guided through one opening, and one nut per anchor rod being mounted on an underside of the first anchor plate, the anchoring device further comprising either

- a second anchor plate, the second anchor plate having openings, one of the anchor rods being guided through each opening, and two other nuts per anchor rod fixing the second anchor plate on an anchor plate topside and on the anchor plate underside;
- other anchor plates corresponding to the number of anchor rods, each of the other anchor plates having an opening, one of the anchor rods being guided through each opening, and two other nuts per anchor rod fixing the other anchor plates on the anchor plate topside and on the anchor plate underside.

Particularly preferably, the anchoring device comprises other anchor plates in addition to the first anchor plate, each of the other anchor plates having at least one opening, one of the anchor rods being guided through each opening, and two other nuts per anchor rod fixing the at least two anchor plates on the anchor plate topside and on the anchor plate underside.

Thus, the anchoring device can have two other anchor plates if there are two anchor rods, two or three other anchor plates if there are three anchor rods, three or four other anchor plates if there are four anchor rods, etc.

The first anchor plate can be understood as an anchor template. An opening can be understood as a bore or a borehole. The second anchor plate and the other anchor plates can be understood as a bracing, a bracing means or a bracing plate.

A recess can be understood as an opening. The recess penetrates the first anchor plate. A central recess can be understood as a recess which is disposed in the center or approximately in the center of the first anchor plate. Preferably, the recess is configured to accommodate a pocket formwork.

The shaping of the outer contour of the first anchor plate and/or the other anchor plates can basically be formed according to the outer contour of all known geometrical shapes. The selection of the shape of the outer contour depends on the outer contour of the column. For instance, a circular outer contour will be used for a round tubular column if a column base plate to be connected also has such an outer contour and the anchor rods are disposed along a circular line and parallel to each other between the bracing plate and the column base plate.

The shaping of the inner contour of the opening or the recess in the first anchor plate is not subject to strict specifications. It can have any known geometrical shape, a rectangular, square or circular contour being particularly preferred. The same applies to the shaping of the pocket formwork which will be inserted into the recess and which will be removed again after grouting. The shaping of the pocket, and thus the shaping of the body of the pocket formwork, can be cuboid-shaped, cubic, pyramidal, cylindrical, frustoconical or semispherical. Preferably, the selection of the shaping of the recess contour and the cross-sectional contour of the pocket formwork should result in a form fit when the pocket formwork is inserted into the recess.

Basically, anchor-plate spacer elements can also be used instead of the at least two anchor rods. They can differ from the rods in shape and still provide sufficient stability. The anchor rods can be configured as anchor bolts or as anchor supports in the form of anchor-plate spacer elements, for example. The end faces of the spacer element preferably each have two shorter anchor rods which accommodate the nuts and the anchor plates.

The number of anchor rods can be freely selected. For reasons of stability when mounting of the column, at least three anchor rods are preferably used since a column base can thus be placed and aligned on a sufficiently stable first anchor plate. For reasons of stability when mounting the column, four anchor rods are preferably used. Particularly preferably, more than four anchor rods are used. This results in a higher-than-average stability.

During production, the anchoring device is merely screwed together and not welded. This allows the anchoring device to be adjusted afterward. Furthermore, high-strength anchor rods of grade 8.8 may also be used, 10.9 and 12.9 and all other material grades being possible as well. In this way, high tensile forces can be transmitted with a relatively low nominal diameter of the anchor rods. The anchoring device can be understood as an anchor cage or a reinforcement cage. Anchor rods can also be understood as anchor bolts or threaded rods. At least some of the anchor rods have one or more threads. Accordingly, all nuts used have an internal thread which meshes with the thread of the anchor rods.

When installing the anchoring device in a concrete foundation, the first anchor plate with the recess can be placed at a diameter-dependent distance from the upper edge of a foundation, in particular in the form of an anchor template.

This can ensure that the nuts located on the underside of the first anchor plate can still be turned.

Preferably, the first anchor plate is spaced apart from the second anchor plate and/or the other anchor plates. This provides the anchoring device with sufficient stability. The distance is to be selected in such a manner that it satisfies the static requirements on the one hand and a sufficiently large concrete overlap is present between a pocket to be produced and the bracing on the other hand. A distance between the first anchor plate and the second and/or the other anchor plates can be 20 cm or more, for example.

Preferably, each of the other anchor plates has at least one opening.

Further preferably, the openings are disposed at the edges of the anchor plates. Thus, the anchor rods can be easily passed through the anchor plate.

Particularly preferably, a pocket formwork is inserted in the central recess of the first anchor plate, flanges or folded edges of the pocket formwork resting flat on the topside of the first anchor plate. In other words, the recess of the first anchor plate is configured to accommodate the pocket formwork. Thus, the pocket formwork can be easily mounted. The pocket formwork serves to produce a pocket. A pocket can be understood as a cavity, a space, a recess or a cut-out in a foundation.

Preferably, the pocket formwork also has openings, the anchor rods penetrating the openings. In this way, the pocket formwork is connected to the first anchor plate in a simple manner.

Preferably, the anchoring device further comprises nuts disposed on the topside of the anchor plate or centering disks and nuts disposed on a base plate topside or on a flange topside, the nuts being mounted on the anchor rods in a rotatable manner. Thus, the first anchor plate and the pocket formwork are fixable.

The anchorage according to the disclosure comprises a concrete foundation, a column, in particular a steel column or a partially concrete-encased column, and an anchoring device according to any one of the preceding claims, a column base of the column resting on the first anchor plate, a shear key being disposed on a column base underside, and the anchor rods being guided through openings of the column base, and centering disks being disposed on the column base topside, and the centering disks being attached to the anchor rods by means of nuts.

For the mounting of columns, the first anchor plates (templates) of all anchoring devices located in the same construction section are adjusted to the same height by turning the nuts located on the underside of the first anchor plates. To do so, the nuts disposed on the anchor plate topside have to be removed first. In this manner, a mounting plane can be obtained through which all steel columns can be mounted at exactly the same height (z-direction) without installing filler plates. After levelling, the nuts are screwed back onto the anchor rods to fix the centering disks on the column base plate.

In order to enable an adjustability of the columns in an x-direction and a y-direction, large openings or large bores are disposed in the column base plates of the columns. Constructively, the bore diameter can be selected freely, for example. The bore diameter can be a multiple of, e.g., three times, the nominal diameter of the anchor rod. This leads to a tolerance range of plus/minus one nominal diameter of the anchor rod for shifting the column in the x-direction and the y-direction.

The large bores can be covered with the centering disks. A centering disk can be understood as an eccentric disk. Preferably, the disks are of such a size that the opening or the bore plus an overlap selected according to static requirements is covered in any position of the anchor rod relative to the opening center or the bore center. The shaping of the outer contour of the centering disk or the eccentric disk can also be formed according to the outer contour of all known geometrical shapes. Preferably, circular and/or square outer contours are mentioned here for the centering disks.

The disks are not welded to the anchor plate. Consequently, there is no need to repair the anticorrosive coating afterward.

Since the anchor rods cannot transmit forces due to the large bores orthogonally to the anchor rod, an additional construction element is required. A shear key is employed. The shear key has a cross section which fulfills the static requirements. Basically any known sections and individually produced or welded sections are possible for the shear key. The shear key is welded to the underside of the column base. Since the column base plate rests or is placed directly on the first anchor plate, an opening is needed in the first anchor plate for passing the shear key through it.

Producing the foundation requires producing the pocket into which the shear key protrudes and via which the loads can be transmitted orthogonally to the anchor rod after the column has been mounted and the pocket has been grouted.

Preferably, the shear key is welded to the column base. Shear forces can thus be absorbed in a simple manner. The shear key can be an I-section. Other commercially available sections which fulfill the static requirements can be used as well. Basically all known sections and individually produced or welded sections are possible for the shear key.

Preferably, the second anchor plate and the anchor rods are encased in the concrete foundation, there being a distance between a concrete foundation topside and the nuts of the first anchor plate which are disposed on the anchor plate underside. There has to be enough distance between an underside of the nuts and the concrete foundation topside for the nuts to be able to be turned for leveling the upper anchor plates. This leads to a sufficient static connection between the foundation and the anchoring device.

Further preferably, a pocket is disposed between the concrete foundation and the column base, the nuts disposed on the anchor plate underside, the first anchor plate, and the shear key being disposed or inserted in the pocket. This allows the first anchor plate to be leveled by turning the nuts disposed on the anchor plate underside for accommodating the column. For leveling, the nuts of the first anchor plate which are disposed on the anchor plate topside have to be removed first, as mentioned above. Preferably, the pocket is mortared or concreted. This takes place after the alignment of the steel structure or the steel column.

The method according to the disclosure for producing a load-bearing anchorage comprises the following steps:

- encasing an anchoring device, in particular one according to any one of the preceding claims, in a concrete foundation, the second anchor plate and the anchor rods being encased in the concrete foundation, and there being a distance between the concrete foundation topside and the nuts of the first anchor plate which are disposed on the anchor plate underside,
- leveling or aligning the first anchor plate by turning the nuts of the first anchor plate which are disposed on the anchor plate underside,
- placing a column base of a column on the first anchor plate, a shear key being disposed on the column base underside, the shear key protruding into a pocket of the foundation, and the projecting anchor rods penetrating openings of the column base, disposing centering disks on the column base topside, and tightening nuts disposed on a centering disk topside to fix the centering disks.

The nuts of the first anchor plate which are disposed on the anchor plate topside are removed before the first anchor plate is leveled or aligned.

Preferably, a pocket formwork is introduced into the central recess of the first anchor plate in order to produce the pocket in the concrete foundation, the pocket formwork being removed again after the pocket has been produced in the concrete foundation. Thus, the pocket formwork can be reused.

Particularly preferably, the method additionally comprises the following step:

filling the pocket with non-shrink mortar or concrete in the area between the underside of the column base and the topside of the foundation.

The anchor bars project far enough from the topside of the foundation. When the steel column is placed on the foundation, the shear key enters the pocket, which is sufficiently large for there to be a space between the shear key and the inner surface of the recess when the steel column sits on the foundation in the end position.

Once the steel column is aligned, the anchor bolts are fixed to the column base topside at the flange by means of the centering disks, and the foundation recess between the shear key, the flange underside and the foundation recess is filled with non-shrink mortar/concrete.

Thus, the entire mounting takes placed without rework on the foundation the flange (column base plate) and the anchors.

Inserting a polystyrene block for producing a corresponding recess in a foundation is known from the state of the art.

In the case at hand, a formwork device screwed to the anchor rods is used when installing the anchoring device to ensure that a pocket of the required size is produced at exactly the right position when concreting the foundation.

Preferably, the formwork device is made of a material with which the adhesion of concrete or mortar can be effectively prevented using formwork oil. Preferably, the material is weather-resistant.

Particularly preferably, the formwork device is reusable. This is advantageous in particular in connection with standardized anchoring devices since the formwork device can be procured from the same supplier/manufacturer who also supplies the anchoring device.

Moreover, this kind of pocket formwork renders the laborious cleaning involved in the use of polystyrene blocks and the accompanying disposal of the scrap polystyrene unnecessary.

After the grouting of the pocket, a column anchorage allowing a statically ideal load introduction of all occurring forces (x, y, z) into the foundation can be achieved.

In another embodiment, clamping at the column base point can be achieved. Said clamping is produced by a statically required arrangement of the anchor rods relative to the column cross section.

Preferably, high-strength anchor rods of grades 8.8, 10.9 or 12.9 are used; all other material grades according to the current standards can be used as well. Their number, diameter and anchoring length are to be selected according to the static requirements. Moreover, the dimensions of the bracing (second anchor plate) are to be considered, the bracing length as well as the dimensions depending on the concrete reinforcement as well as the concrete grade.

The dimensions of the anchoring device depend on both the constructive and the static requirements.

Hereinafter, the disclosure will be explained in more detail with reference to the accompanying drawings.

Figure 1:
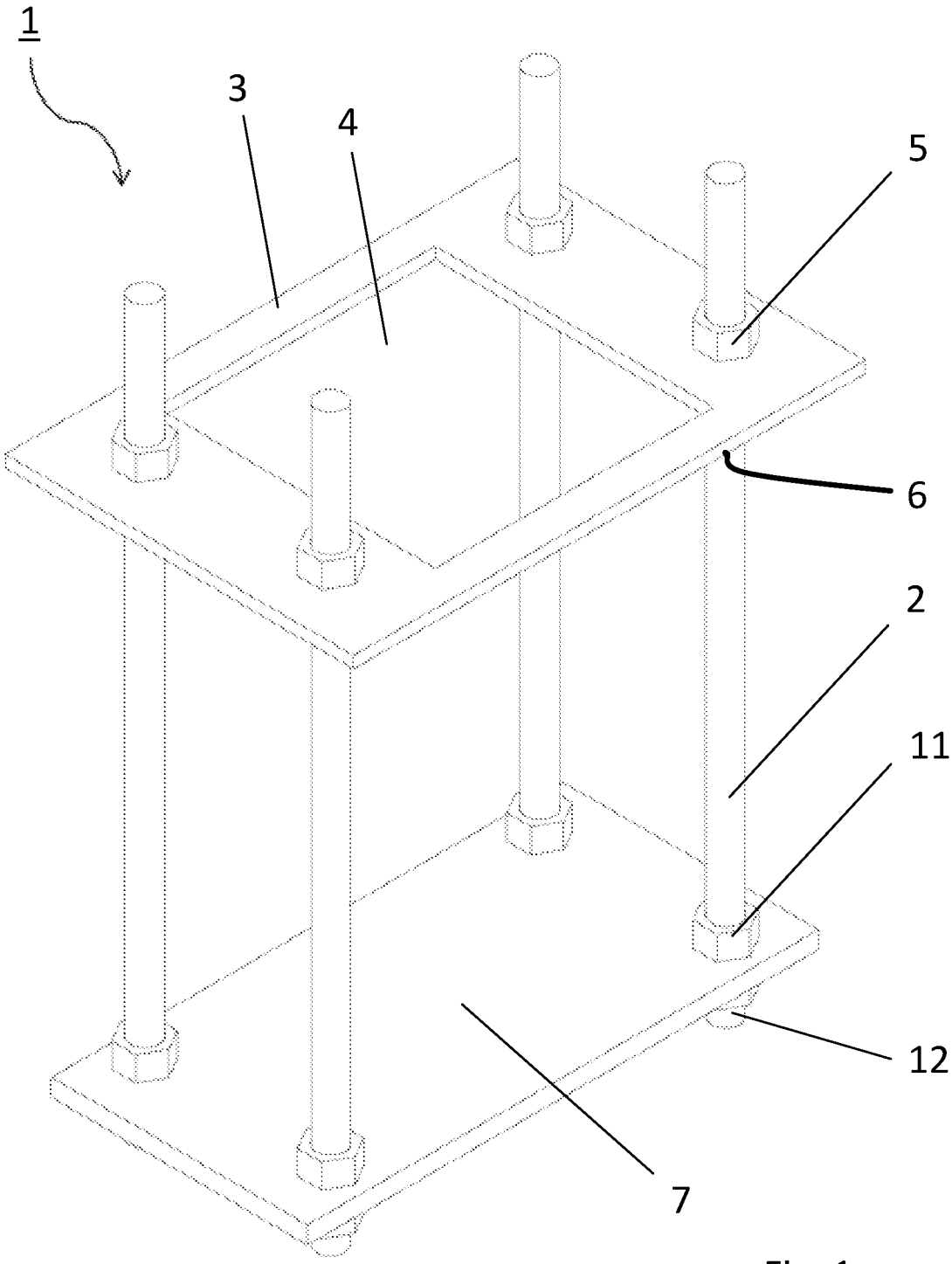
FIG. 1 is a schematic view of an embodiment of the anchoring device according to the disclosure.
Figure 4:
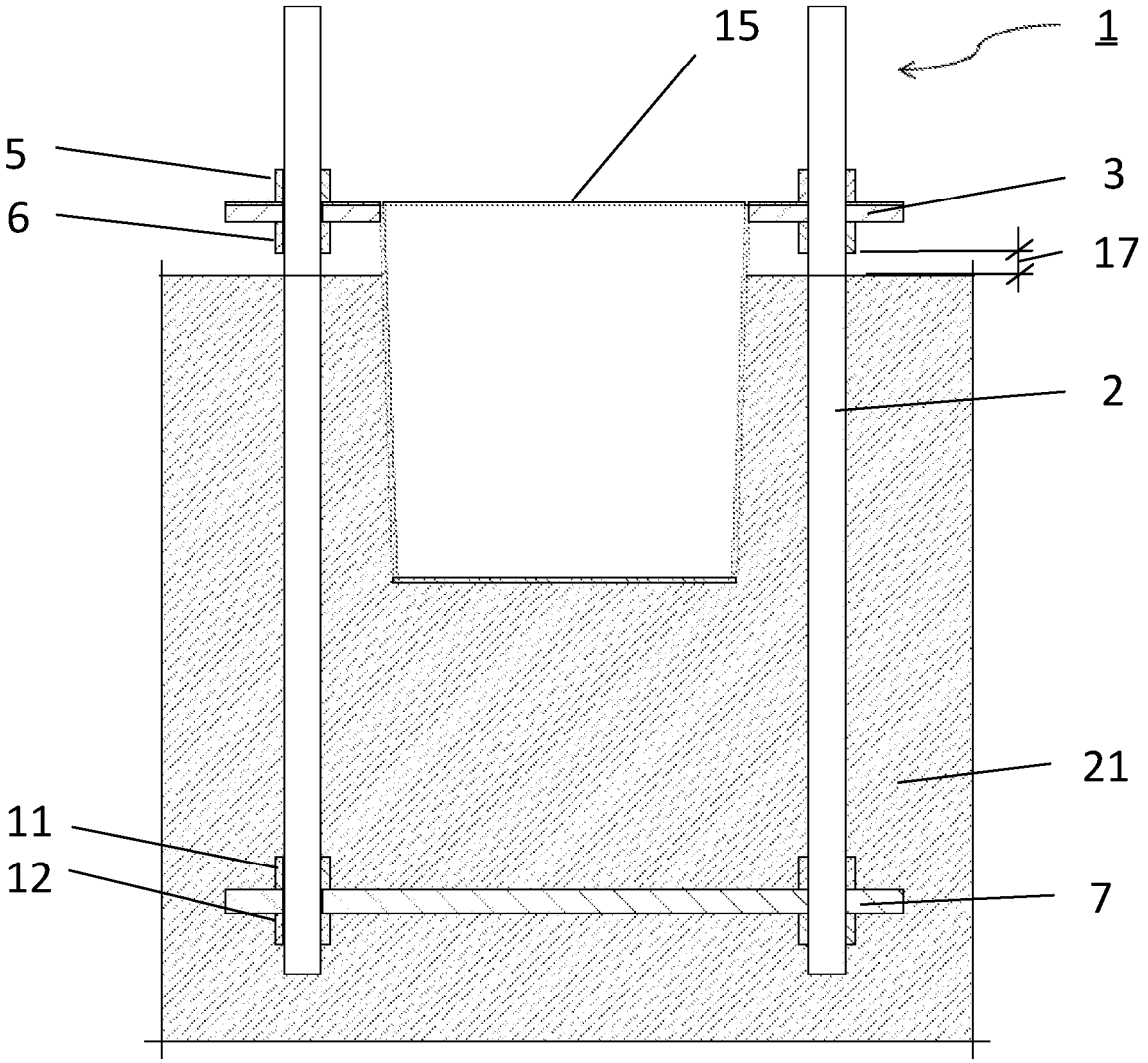
FIG. 4 is a section A-A through the anchorage of FIG. 3.

FIG. 1 shows an anchoring device 1. Anchoring device 1 comprises four anchor rods 2 and a first anchor plate 3. First anchor plate 1 can be understood as an anchor template. First anchor plate 3 has a central recess 4 and boreholes. Each anchor rod 2 is guided through one of the boreholes. One nut 6 is screwed onto each anchor rod 2. Nuts 6 serve as a rest for first anchor plate 3, nuts 6 being disposed on the anchor plate underside. In FIG. 1, nut 6 is covered by first anchor plate 3. They are shown in FIG. 4, for example. Furthermore, nuts 5 are provided. Nuts 5 serve to fix or position first anchor plate 3, nuts 5 being disposed on the anchor plate topside.

Anchoring device 1 further comprises a second anchor plate 7. The second anchor plate can be understood as a bracing or a bracing plate. Second anchor plate 7 has boreholes. Each anchor rod 2 is guided through one of the boreholes. Two nuts 11 and 12 are screwed onto each anchor rod 2. Nuts 12 serve as rests for second anchor plate 7, nuts 12 being disposed on the anchor plate underside. Nuts 11 serve to fix or position second anchor plate 7, nuts 11 being disposed on the anchor plate topside.

First anchor plate 3 is spaced apart from second anchor plate 7. The boreholes of anchor plates 3 and 7 are disposed along the edges of anchor plates 3 and 7.

Figure 2:
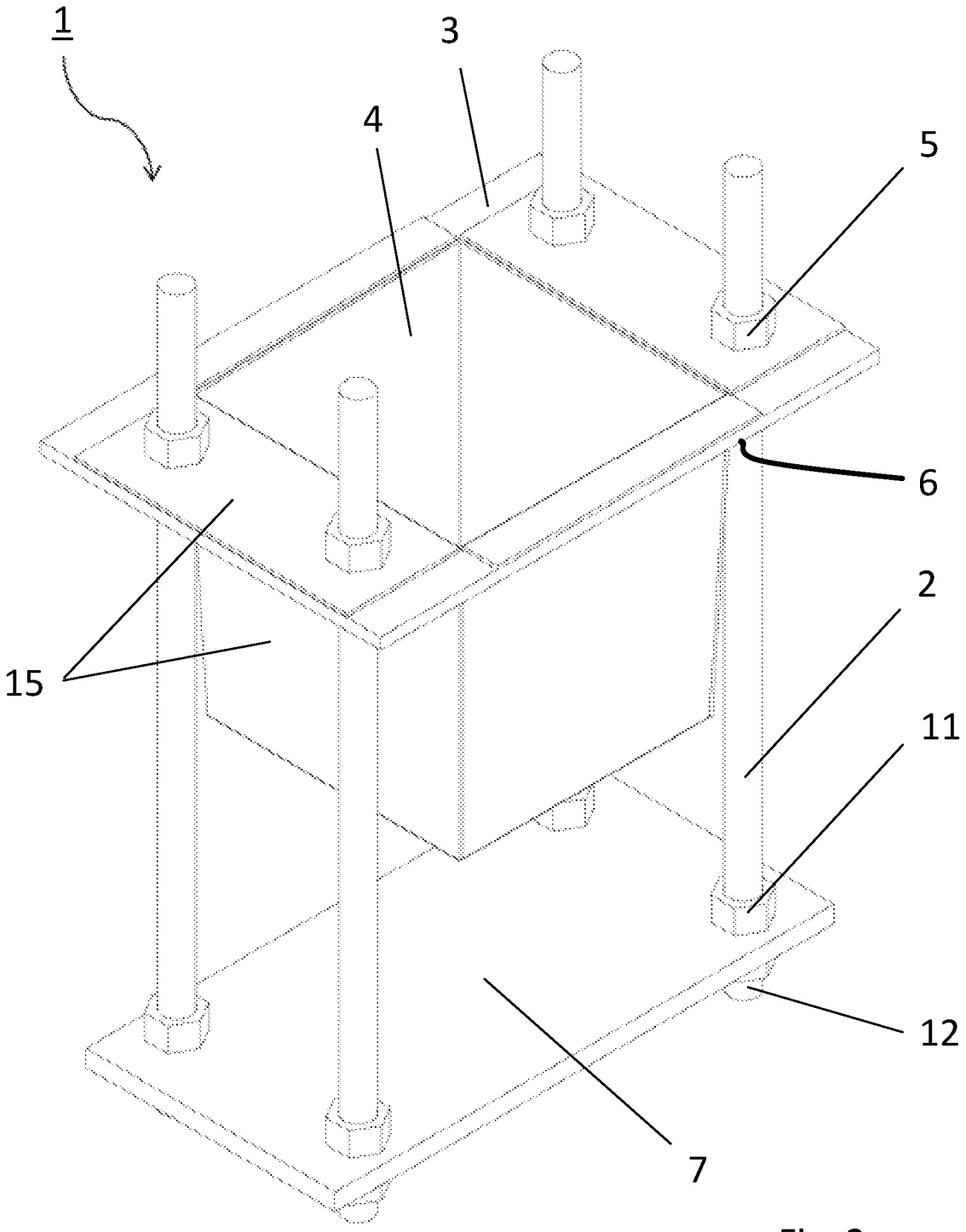
FIG. 2 is the schematic view of the anchoring device of FIG. 1 with another component.

FIG. 2 shows anchoring device 1 from FIG. 1 with another component. Anchoring device 1 additionally has a pocket formwork 15. Pocket formwork 15 is inserted in central recess 4 of first anchor plate 3. Flanges or folded edges of pocket formwork 15 rest flat on the topside of first anchor plate 3. Pocket formwork 15 has openings, anchor rods 2 penetrating the openings. Nuts 5 are now attached to anchor rods 2 on the flange topside.

Pocket formwork 15 serves to produce a foundation recess, which is called a pocket (German: Kŏcher) in professional terminology, in a concrete foundation, as described in more detail below.

Figure 3:
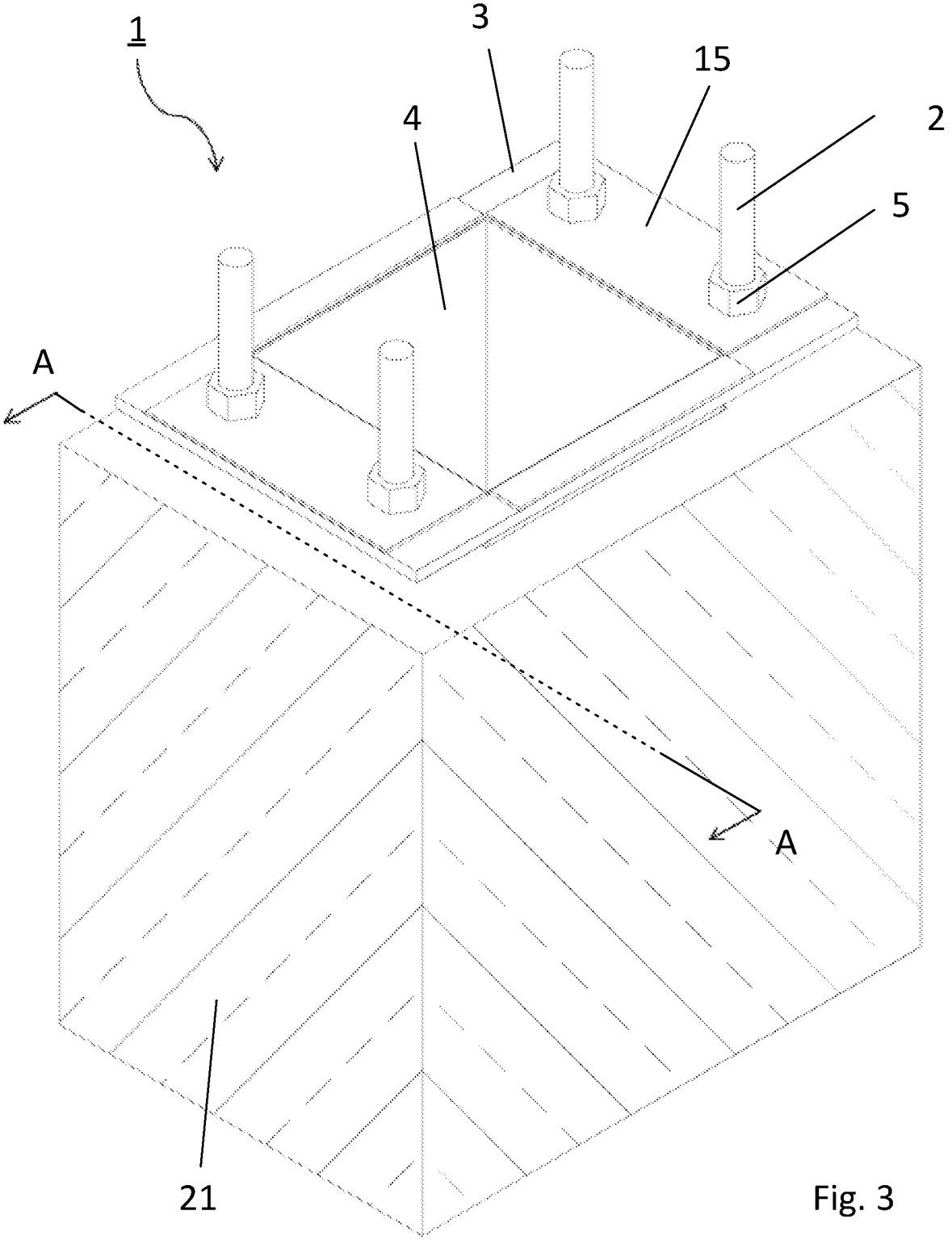
FIG. 3 is a schematic view of an anchoring device of FIG. 2 encased in concrete.

FIG. 3 shows an anchoring device 1 with a pocket formwork 15 from FIG. 2 encased in a concrete foundation 21.

First, anchoring device 1 is encased in concrete foundation 21, first anchor plate 3 being placed far enough above concrete foundation 21 for nuts 6 of first anchor plate 3, which are disposed on the underside of first anchor plate 3, to be disposed far enough above concrete foundation 21 to allow first anchor plate 3 to be adjusted upward (positive Z-direction in the drawing plane) and downward (negative Z-direction in the drawing plane) along the length of anchor rods 2 by turning nuts 6. Nuts 5 are removed prior to leveling. Nuts 5 will later be screwed back onto anchor rods 2 when mounting the column for attaching column base 23 by means of centering disks 26.

Subsequently, first anchor plate 3 is leveled or aligned by turning nuts 6 of first anchor plate 3, which are disposed on the anchor plate underside. For mounting column 22, all first anchor plates 3 located in the construction section are adjusted to the constructively required height by turning nuts 6, which are disposed on the anchor plate underside.

For producing pocket 25 in concrete foundation 21, pocket formwork 15 is introduced into central recess 4 of first anchor plate 3. Pocket formwork 15 is removed again after pocket 25 has been produced in concrete foundation 21.

FIG. 4 shows a section A-A from FIG. 3. Second anchor plate 7 and anchor rods 2 are encased in concrete foundation 21 below nuts 6 of first anchor plate 3, which are disposed on the anchor plate underside. The surface of concrete foundation 21 is spaced apart from nuts 6 (distance 17).

Figure 5:
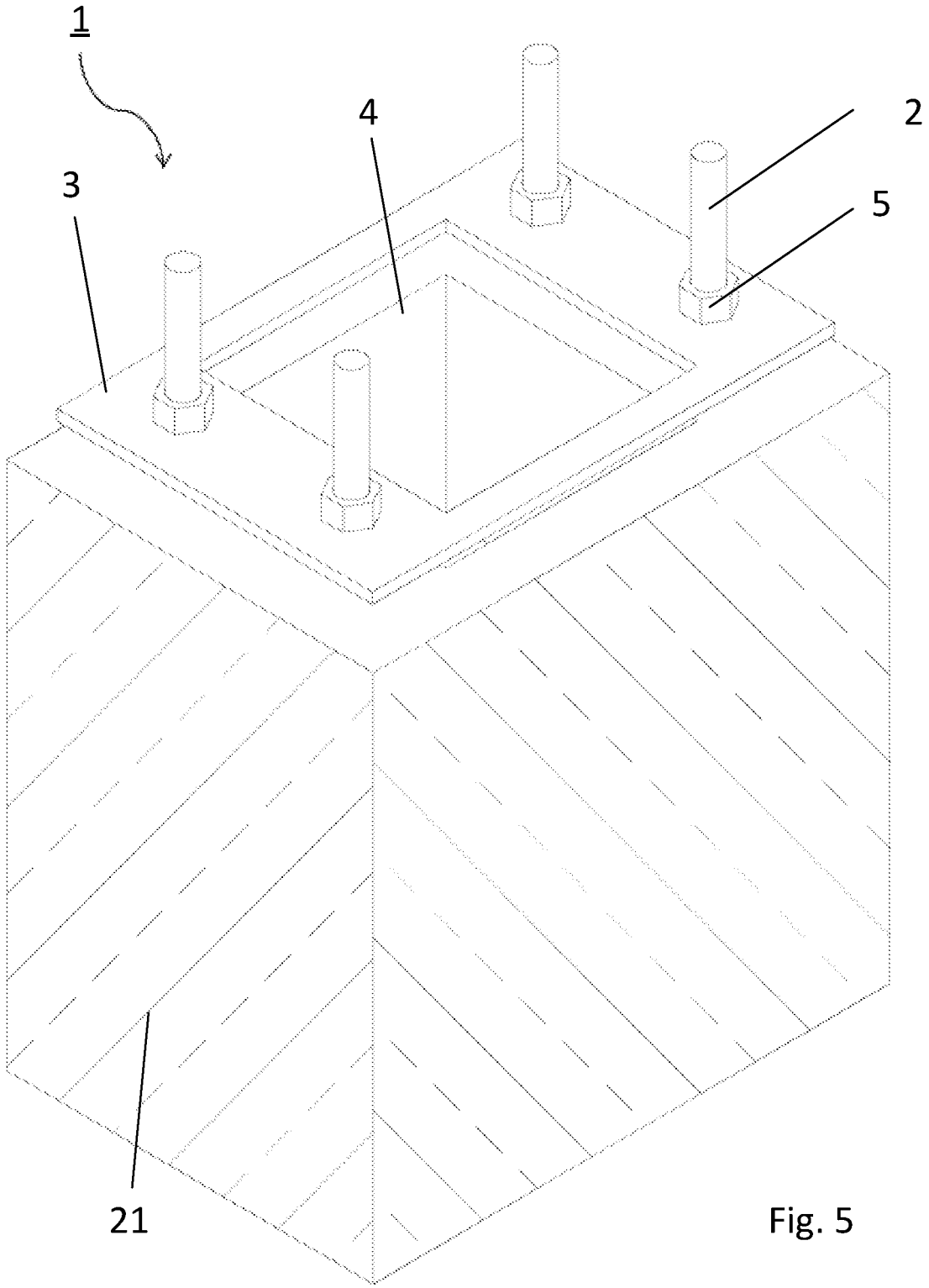
FIG. 5 is another schematic view of the anchoring device encased in concrete.

FIG. 5 shows encased anchoring device 1 from FIG. 3, pocket formwork 15 having been removed again after the concreting process of concrete foundation 21 and nuts 5 again resting on the plate topside. However, nuts 5 are not needed at this stage of the method.

Figure 6:
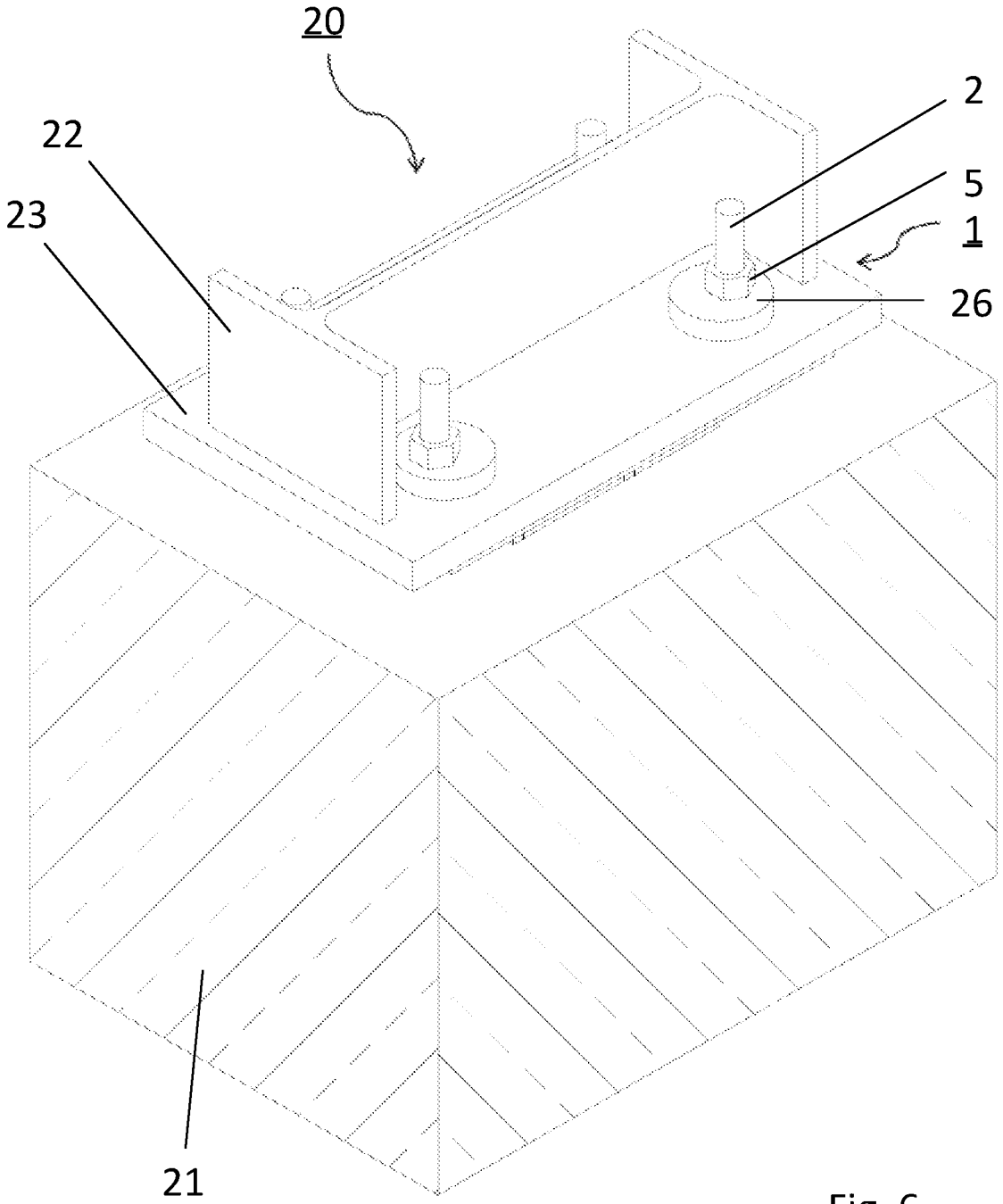
FIG. 6 is a schematic view of an embodiment of the anchorage according to the disclosure.

FIG. 6 is a schematic view of an anchorage 20. Anchorage 20 comprises a concrete foundation 21, a column 22, in particular a steel column or a partially concrete-encased column, which has a column base or a column base plate 23, and anchoring device 1, as described above.

When placing column base 23 of column 22 on first anchor plate 3, a shear key 24 is disposed on the column base underside. Shear key 24 protrudes into pocket 25 of foundation 21. Projecting anchor rods 2 penetrate boreholes of column base 23.

A centering disk 26 is disposed on each anchor rod 2 on the column base topside. Subsequently, nuts 5, which are disposed on the anchor plate topside and which are mounted on anchor rods 2 in a rotatable manner, are tightened until they come into contact with the centering disks.

Figure 7:
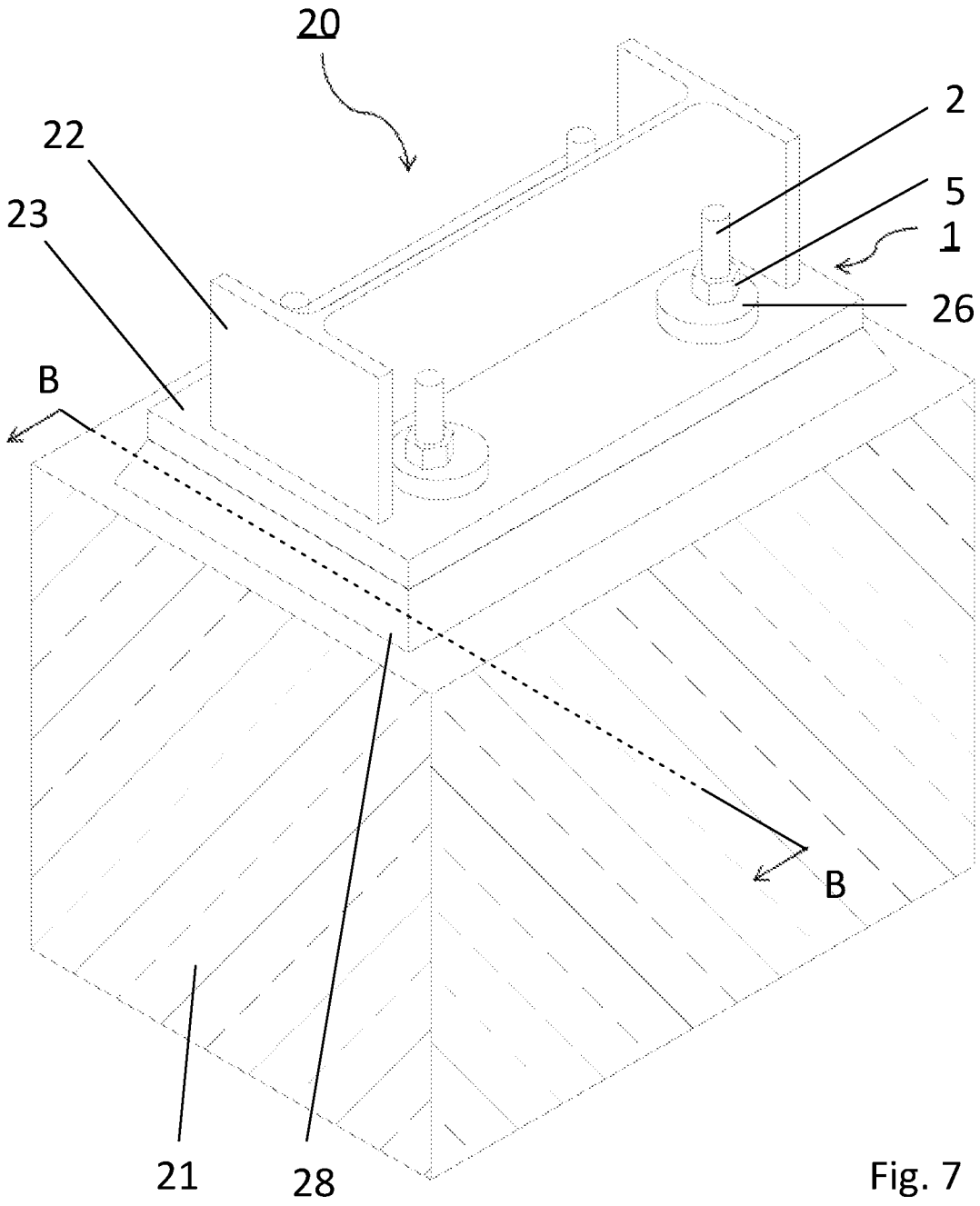
FIG. 7 is a schematic view of the embodiment of the anchorage of FIG. 6 with additions.

FIG. 7 shows anchorage 20 from FIG. 6 with additions. A cavity disposed between concrete foundation 21 and column base 23 in the form of a pocket 25 (cf. FIG. 8) between the flange underside of column base 23 and the bottom of the foundation recess is mortared with non-shrink mortar 28 or is alternatively concreted.

Figure 8:
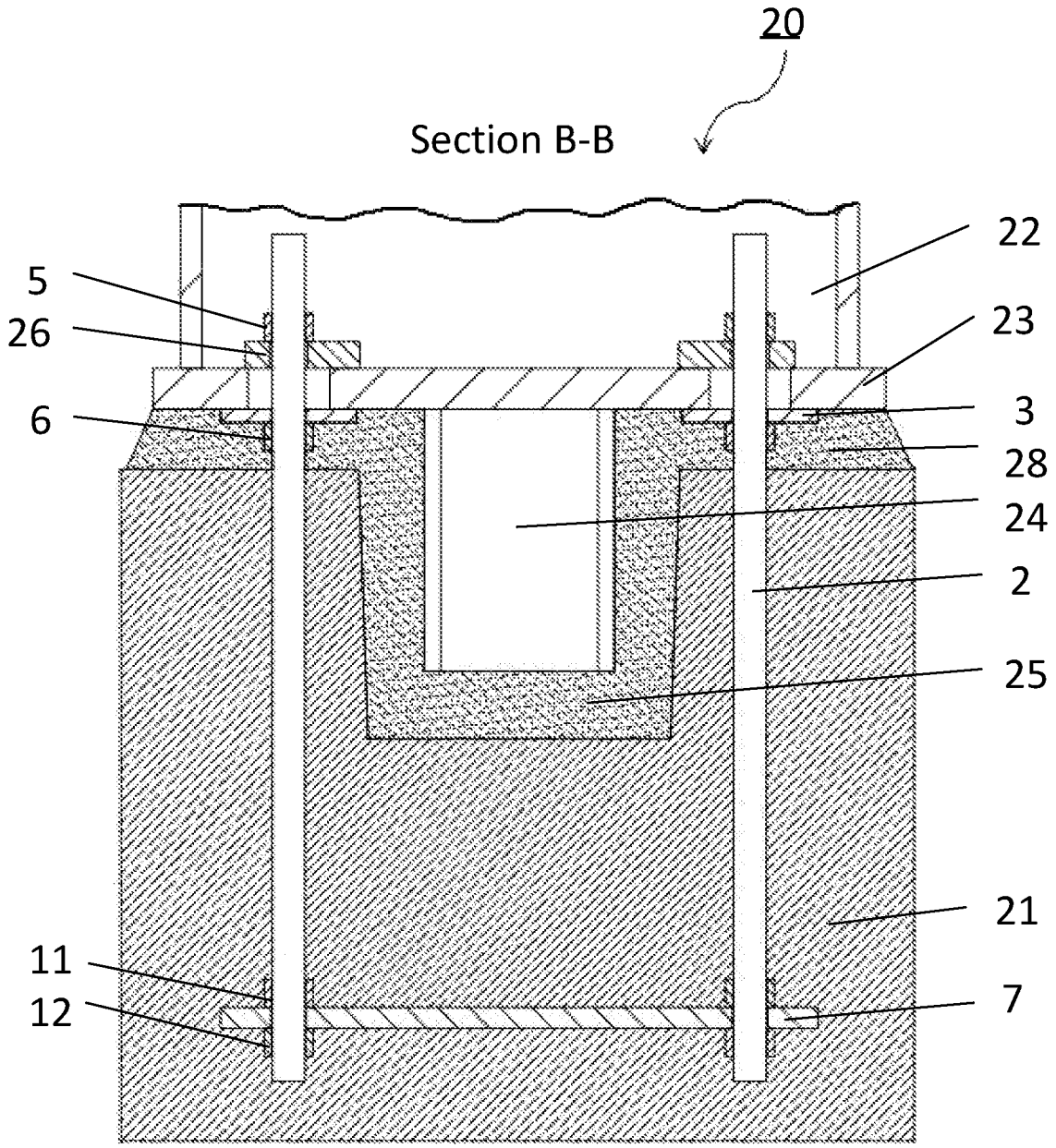
FIG. 8 is a section B-B through the anchorage of FIG. 7.

FIG. 8 shows a section B-B through the anchorage of FIG. 7.

A column base 23 of column 22 rests on first anchor plate 3, a shear key 24 being disposed on the column base underside. Anchor rods 2 are guided through openings of column base 23. Furthermore, centering disks 26 are disposed on the column base topside. Centering disks 26 themselves are attached to anchor rods 2 by means of nuts 5.

Shear key 24 has an I-section.

Second anchor plate 7 and anchor rods 2 are encased in concrete foundation 21 below nuts 6 of first anchor plate 3, which are disposed on the anchor plate underside, a space existing between the surface of concrete foundation 21 and nuts 6.

As mentioned above, pocket 25, which is disposed between concrete foundation 21 and column base 23, is mortared or concreted.

Nuts 6 of first anchor plate 3, which are disposed on the anchor plate underside, and first anchor plate 3 are disposed in pocket 25.

Figure 9:
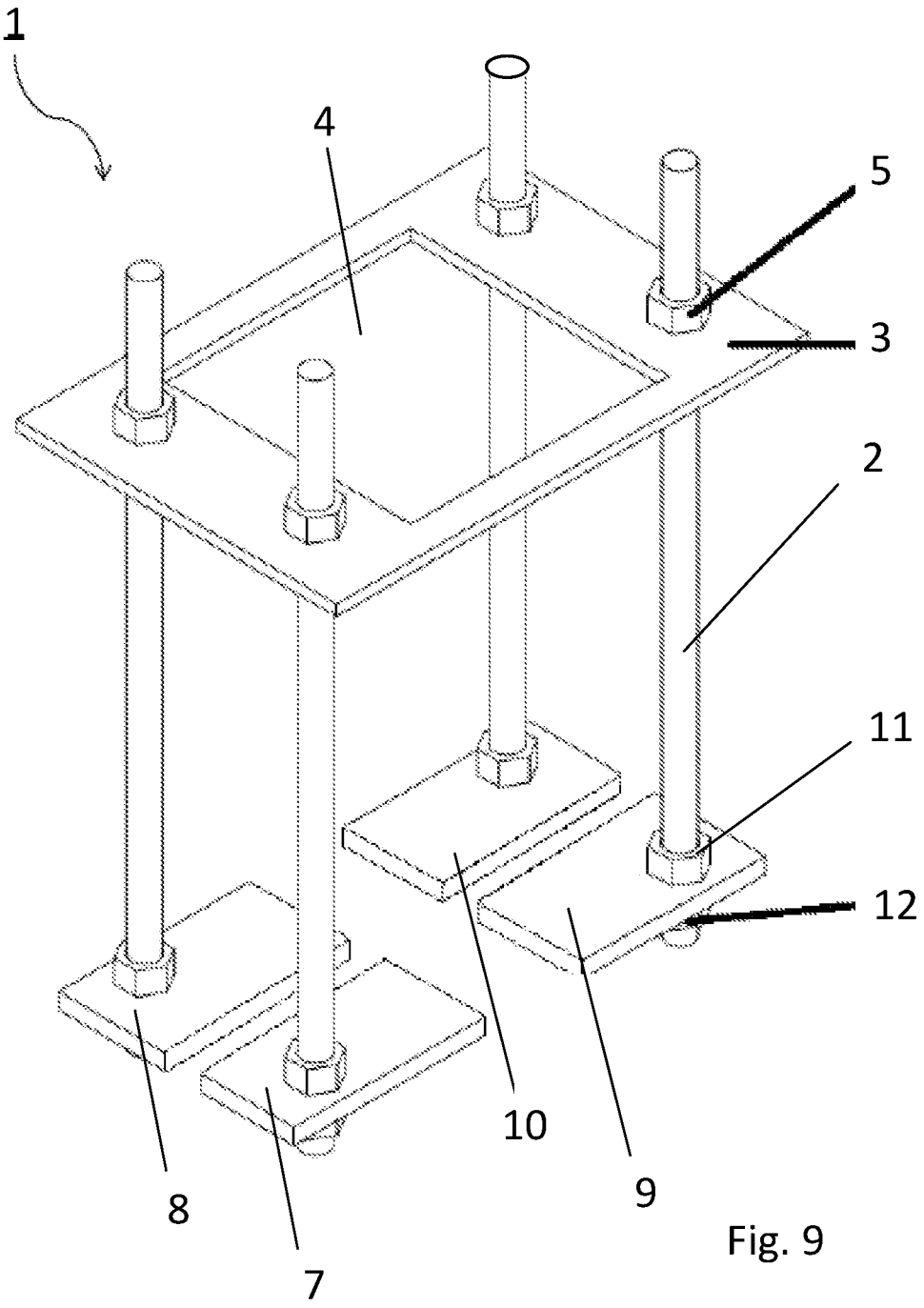
FIG. 9 is a schematic view of another embodiment of the device according to the disclosure of FIG. 1.

FIG. 9 shows another embodiment of anchoring device 1. Anchoring device 1 comprises four anchor rods 2 and a first anchor plate 3. First anchor plate 1 can be understood as an anchor template. First anchor plate 3 has a central recess 4 and boreholes. Each anchor rod 2 is guided through one borehole. One nut 6 is screwed onto each anchor rod 2. Nuts 6 serve as rests for first anchor plate 3, nuts 6 being disposed on the anchor plate underside. Furthermore, nuts 5 are provided. In FIG. 9, nut 6 is covered by first anchor plate 3. Nuts 5 serve to fix or position first anchor plate 3, nuts 5 being disposed on the anchor plate topside.

Anchoring device 1 comprises other anchor plates 7, 8, 9 and 10. The other anchor plates can be understood as bracings or bracing plates. Each of anchor plates 7, 8, 9 and 10 has a borehole. Each anchor rod 2 is guided through one of the boreholes. Two nuts 11, 12 are screwed onto each anchor rod 2. Nuts 12 serve as rests for anchor plates 7, 8, 9 and 10, nuts 12 being disposed on the anchor plate underside. Nuts 11 serve to fix or position anchor plates 7, 8, 9 and 10, nuts 11 being disposed on the anchor plate topside.

First anchor plate 3 is spaced apart from other anchor plates 7, 8, 9 and 10. The boreholes of anchor plates 3, 7, 8, 9 and 10 are disposed along the edges of anchor plates 3, 7, 8, 9 and 10.

Anchoring device 1 of FIG. 9 shows another option for configuring the anchoring device.

As another alternative, at least two other anchor plates 7, 8 can be used instead of the four anchor plates 7, 8, 9 and 10 shown in FIG. 9.

In this case, first other anchor plate 7 can replace anchor plates 7 and 8 from FIG. 9, and second other anchor plate 8 can replace anchor plates 9 and 10 from FIG. 9. Furthermore, first other anchor plate 7 can replace anchor plates 7 and 9 from FIG. 9, and second other anchor plate 8 can replace anchor plates 8 and 10 from FIG. 9.

The other two anchor plates 7 and 8 then have at least one opening, one of the anchor rods being guided through each of the openings, and two other nuts per anchor rod fixing the two other anchor plates 7 and 8 on the anchor plate topside and on the anchor plate underside.

This shows another option for configuring the anchoring device.

As another alternative, at least three other anchor plates 7, 8, 9 can be used instead of the four anchor plates 7, 8, 9 and 10 shown in FIG. 9. In this case, one of the anchor plates can have two openings, an anchor rod 2 being guided through each opening. The second and third anchor plates can each have one opening with one anchor rod 2 guided therein. Thus, a plurality of possible combinations with three bracing plates and four anchor rods can be realized.

Thus, different options of how to divide the second anchor plate into one, two, three or more bracing plates arise depending on the need and the number of anchor rods. Individual bracing plates can have one, two or more openings or bores for accommodating one, two or more anchor rods depending on how the second anchor plate is divided, which means there are various possible combinations and arrangements between the number of the individual bracing plates and the number of openings for accommodating anchor rods in the respective bracing plates. Also, the outer contours of the individual bracing plates can be formed according to all known shapes; the shaping of the outer contour of each of the individual bracing plates can be selected individually, allowing a uniform shaping of outer contours or any possible mixture of outer contours to be obtained.

REFERENCE SIGNS

1 anchoring device
2 anchor rod
3 first anchor plate (anchor template)
4 recess
5 nut
6 nut
7 second anchor plate (bracing)
8 third anchor plate (bracing)
9 fourth anchor plate (bracing)
10 fifth anchor plate (bracing)
11 nut
12 nut
15 pocket formwork
17 distance (space)
20 anchorage (load-bearing structure)
21 concrete foundation
22 column
23 column base (column base plate)
24 shear key
25 pocket (cavity)
26 centering disk
28 mortar

The invention claimed is:

1. An anchoring device comprising at least two anchor rods and a first anchor plate, the first anchor plate having a central recess and openings, each anchor rod being guided through one openings, and one nut per each anchor rod being mounted on an underside of the first anchor plate, the anchoring device further comprising either a) a second anchor plate, the second anchor plate having openings, one of the anchor rods being guided through each opening of the second anchor plate, and two other nuts per each anchor rod fixing the second anchor plate to the underside of the first anchor plate and to a topside of the first anchor plate, or b) other anchor plates corresponding to the number of anchor rods, each of the other anchor plates having an opening, one of the anchor rods being guided through each opening of the other anchor plates, and two other nuts per each anchor rod fixing the other anchor plates to the topside of the first anchor plate and to the underside of the first anchor plate;

wherein a pocket formwork is inserted in the central recess of the first anchor plate, and flanges of the pocket formwork rest flat on the topside of the first anchor plate.

2. The anchoring device according to claim 1, wherein, under alternative condition (a), the first anchor plate is spaced apart from the second anchor plate.

3. The anchoring device according to claim 1, wherein, under alternative condition (a), a distance between the first anchor plate and the second anchor plate is at least 20 cm.

4. The anchoring device according to claim 1, wherein the openings are disposed at edges of the anchor plates.

5. The anchoring device according to claim 1, wherein the pocket formwork has openings and the anchor rods penetrate the openings of the pocket formwork.

6. The anchoring device according to claim 1, further comprising a column base plate with centering disks and nuts disposed on a column base plate topside for mounting the column base plate on the anchor rods after the pocket formwork is removed.

7. An anchorage comprising a concrete foundation, a column, and an anchoring device according to claim 1, a column base of the column configured to rest on the first anchor plate following a removal of the pocket formwork from the central recess of the first anchor plate, wherein a shear key is disposed on an underside of the column base for insertion in a pocket formed by the pocket formwork, and wherein the anchor rods are capable of being guided through openings of the column base, and centering disks for disposal on a topside of the column base, and the centering disks for attachment to the anchor rods by means of nuts.

8. The anchorage according to claim 7, wherein the shear key is welded to the column base.

9. The anchorage according to claim 7, wherein the second anchor plate under alternative condition (a) or the other anchor plates under alternative condition (b) is/are encased in the concrete foundation and the anchor rods are encased in the concrete foundation, there being a distance between a topside of the concrete foundation and the nuts of the first anchor plate which are disposed on the underside of the first anchor plate.

10. The anchorage according to claim 7, wherein the pocket is disposed between the concrete foundation and the column base, and the nuts of the first anchor plate which are disposed on the underside of the first anchor plate and the shear key are disposed in the pocket.

11. The anchorage according to claim 10, wherein the pocket is concreted or mortared.

12. A method for producing a load-bearing anchorage, the method comprising the following steps:

encasing an anchoring device according to claim 1 in a concrete foundation, the second anchor plate under alternative condition (a) or the other anchor plates under alternative condition (b) being encased in the concrete foundation and the anchor rods being encased in the concrete foundation, and there being a distance between a topside of the concrete foundation and the nuts of the first anchor plate which are disposed on the underside of the first anchor plate, and in which the pocket formwork is introduced into the central recess of the first anchor plate to produce a pocket in the concrete foundation, aligning the first anchor plate by turning the nuts of the first anchor plate which are disposed on the underside of the first anchor plate, removing the pocket formwork after the pocket has been produced in the concrete foundation, placing a column base of a column on the first anchor plate, a shear key being disposed on an underside of the column base, the shear key protruding into the pocket of the foundation, and the projecting anchor rods penetrating openings of the column base, disposing centering disks on a topside of the column base, and tightening nuts disposed on a topside of the centering disk to fix the centering disks.

13. The method according to claim 12, further comprising the following step:

filling the pocket with non-shrink mortar or concrete in the area between the underside of the column base and the topside of the foundation.

14. The anchorage of claim 7, wherein the column is a steel column or a partially concrete-encased column.

15. The anchoring device according to claim 1, wherein, under alternative condition (b), the first anchor plate is spaced apart from the other anchor plates.

16. The anchoring device according to claim 1, wherein, under alternative condition (b), a distance between the first anchor plate and the other anchor plates is at least 20 cm.

* * * * *